US010579084B2

(12) United States Patent
Chen et al.

(10) Patent No.: US 10,579,084 B2
(45) Date of Patent: Mar. 3, 2020

(54) VOLTAGE REGULATOR APPARATUS OFFERING LOW DROPOUT AND HIGH POWER SUPPLY REJECTION

(71) Applicant: MEDIATEK INC., Hsin-Chu (TW)

(72) Inventors: Kuan-Chun Chen, Hsinchu (TW); Chih-Hong Lou, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 16/181,350

(22) Filed: Nov. 6, 2018

(65) Prior Publication Data

US 2019/0235543 A1 Aug. 1, 2019

Related U.S. Application Data

(60) Provisional application No. 62/623,584, filed on Jan. 30, 2018.

(51) Int. Cl.
*G05F 1/61* (2006.01)
*G05F 1/614* (2006.01)
(Continued)

(52) U.S. Cl.
CPC ..... *G05F 1/614* (2013.01); *G05F 1/563* (2013.01); *G05F 1/575* (2013.01); *G05F 1/618* (2013.01); *G05F 1/468* (2013.01)

(58) Field of Classification Search
CPC ..... G05F 1/614; G05F 1/563; G05F 1/468; G05F 1/575
See application file for complete search history.

(56) References Cited

U.S. PATENT DOCUMENTS 8,154,263 B1 * 4/2012 Shi ..... G05F 1/575 323/269
8,159,207 B2 4/2012 Ivanov
(Continued)

FOREIGN PATENT DOCUMENTS

CN 102298407 A 12/2011
CN 102239457 B 7/2014
(Continued)

OTHER PUBLICATIONS

Tsz Yin Man et al., Development of Single-Transistor-Control LDO Based on Flipped Voltage Follower for SoC, Jun. 2008, 1392-1401, vol. 55, IEEE.
(Continued)

*Primary Examiner* — Fred E Finch, III
*Assistant Examiner* — Rafael O. De León Domenech
(74) *Attorney, Agent, or Firm* — Winston Hsu

(57) ABSTRACT

A voltage regulator apparatus includes operational amplifier, first resistor, second resistor, driving transistor, amplifier circuit, and output circuit. The operational amplifier has first input terminal coupled to reference voltage, second input terminal, and output terminal. The first resistor has first terminal coupled to second input terminal. The second resistor is coupled between first resistor and ground level. The driving transistor has control terminal coupled to output terminal of operational amplifier and first terminal coupled to second terminal of first resistor. The amplifier circuit is coupled to output terminal of operational amplifier and configured to sense output voltage of voltage regulator apparatus to amplify the sensed voltage with specific gain to regulate a transistor of output circuit. The transistor has control terminal controlled by amplifier circuit. The output voltage is generated at first terminal of the transistor.

15 Claims, 7 Drawing Sheets

(51) Int. Cl.

| | |
|---|---|
| ***G05F 1/575*** | (2006.01) |
| ***G05F 1/618*** | (2006.01) |
| ***G05F 1/563*** | (2006.01) |
| *G05F 1/46* | (2006.01) |

(56) References Cited

U.S. PATENT DOCUMENTS

| | | | | |
|---|---|---|---|---|
| 2007/0278861 | A1* | 12/2007 | Lou | G05F 1/56 307/66 |
| 2010/0141223 | A1* | 6/2010 | Wadhwa | G05F 1/56 323/280 |
| 2010/0289468 | A1* | 11/2010 | Draghi | G05F 1/575 323/282 |
| 2012/0086282 | A1* | 4/2012 | Lee | G05F 1/56 307/82 |
| 2012/0146595 | A1 | 6/2012 | Wong | |
| 2012/0153910 | A1* | 6/2012 | Bulzacchelli | G05F 1/575 323/272 |
| 2014/0091775 | A1* | 4/2014 | Tan | G05F 1/575 323/280 |
| 2014/0266088 | A1* | 9/2014 | Makino | G05F 1/563 323/266 |
| 2015/0002110 | A1 | 1/2015 | Singh | |
| 2015/0123635 | A1* | 5/2015 | Huang | G05F 1/575 323/281 |
| 2015/0137780 | A1* | 5/2015 | Lerner | G05F 1/56 323/280 |
| 2015/0263683 | A1* | 9/2015 | Kronmueller | H03F 3/04 330/310 |
| 2017/0371366 | A1* | 12/2017 | Liu | G05F 1/575 |
| 2018/0024581 | A1 | 1/2018 | Sabbineni | |

FOREIGN PATENT DOCUMENTS

| | | | |
|---|---|---|---|
| CN | 104181972 | B | 12/2015 |
| CN | 104317349 | B | 3/2016 |
| EP | 3 026 816 | A1 | 6/2016 |

OTHER PUBLICATIONS

Pui Ying or et al., An Output-Capacitorless Low-Dropout Regulator With Direct Voltage-Spike Detection, Feb. 2010, 458-466, vol. 45, IEEE.

Jianping Guo et al., A 6-μW Chip-Area-Efficient Output-Capacitorless LDO in 90-nm CMOS Technology, Sep. 2010, 1896-1905, vol. 45, IEEE.

Peter Hazucha et al., Area-efficient linear regulator with ultra-fast load regulation, Apr. 2005, 933-940, vol. 40, IEEE.

Yi-Tsung Chang et al., LDO Linear Regulator with Super-source Follower, Jun. 10, 2014, 442-445, IEEE, Taiwan.

Yan Lu et al., A Fully-Integrated Low-Dropout Regulator With Full-Spectrum Power Supply Rejection, Mar. 2015, 707-716, vol. 62, IEEE.

Guoyi Yu et al., A FVF LDO regulator with damping-factor-control frequency compensation for SOC application, Oct. 28, 2014, IEEE, China.

Kosta Luria et al., Dual-Mode Low-Drop-Out Regulator/Power Gate With Linear and On-Off Conduction for Microprocessor Core On-Die Supply Voltages in 14 nm, Mar. 2016, 752-762, vol. 51, IEEE.

Guangxiang Li et al., Cascoded flipped voltage follower based output-capacitorless low-dropout regulator for SoCs, Sep. 8, 2015, 368-373, IEEE, China.

Yan Lu et al., A 312 ps response-time LDO with enhanced super source follower in 28 nm CMOS, Aug. 4, 2016, 1368-1370, vol. 52, Electronics Letters.

Yanhan Zeng et al., A FVF based LDO with dynamic bias current for low power RFID chips, Sep. 21, 2016, 61-64, IEEE, China.

Lei Wang et al., A fast transient LDO based on dual loop FVF with high PSRR, Oct. 25, 2016, 99-102, IEEE, South Korea.

Mahender Manda et al., A multi-loop low-dropout FVF voltage regulator with enhanced load regulation, Aug. 6, 2017, 9-12, IEEE, USA.

* cited by examiner

VOLTAGE REGULATOR APPARATUS OFFERING LOW DROPOUT AND HIGH POWER SUPPLY REJECTION

CROSS REFERENCE TO RELATED APPLICATIONS

This application claims priority of U.S. provisional application Ser. No. 62/623,584 filed on Jan. 30, 2018, which is entirely incorporated herein by reference.

BACKGROUND

With development of advanced technology, a power supply voltage level is designed to become smaller and smaller. For example, a power supply voltage level may be designed to become a slightly higher than a threshold voltage of a transistor component. Such smaller voltage supply level introduces a problem that it is difficult to design a low dropout voltage regulator. In addition, another problem may be that the efficiency of a low dropout voltage regulator may become worse. It is difficult to design a low dropout voltage regulator with high power supply rejection capability.

SUMMARY

Therefore one of the objectives of the invention is to provide a novel voltage regulator apparatus which is capable of offering lower dropout, higher power supply rejection, and boosted overall gain, to solve the above-mentioned problems.

According to embodiments of the invention, a voltage regulator apparatus is disclosed. The voltage regulator comprises an operational amplifier, a first resistor, a second resistor, a driving transistor, an amplifier circuit, and an output circuit. The operational amplifier has a first input terminal coupled to a reference voltage, a second input terminal, and an output terminal. The first resistor has a first terminal coupled to the second input terminal. The second resistor is coupled between the first resistor and a ground level. The driving transistor has a control terminal coupled to the output terminal of the operational amplifier and a first terminal coupled to a second terminal of the first resistor. The amplifier circuit is coupled to the output terminal of the operational amplifier, and is configured to sense an output voltage of the voltage regulator apparatus to amplify the sensed voltage with a specific gain to regulate a first transistor of the output circuit. The output circuit has the first transistor which has a control terminal controlled by the amplifier circuit. The output voltage is generated at a first terminal of the first transistor.

These and other objectives of the present invention will no doubt become obvious to those of ordinary skill in the art after reading the following detailed description of the preferred embodiment that is illustrated in the various figures and drawings.

DETAILED DESCRIPTION

The invention aims at providing a solution of a voltage regulator apparatus which can offer low dropout (LDO), good/better line regulation (more stable output voltage), high PSR (power supply rejection) capability or high PSRR (power supply rejection ratio), and a high loop gain. The provided voltage regulator apparatus is suitable for applications which require a very low dropout voltage, a lower power supply voltage, and ultra-high power supply noise rejection, e.g. a radio frequency circuit (but not limited). To achieve this, a specific amplifier circuit/loop comprising a common gate amplifier followed by a common source amplifier is employed and inserted between the output terminal of an operational amplifier and an output stage circuit/branch. In addition, the provided voltage regulator apparatus also achieves lower signal noise and wider bandwidth.

Figure 1:
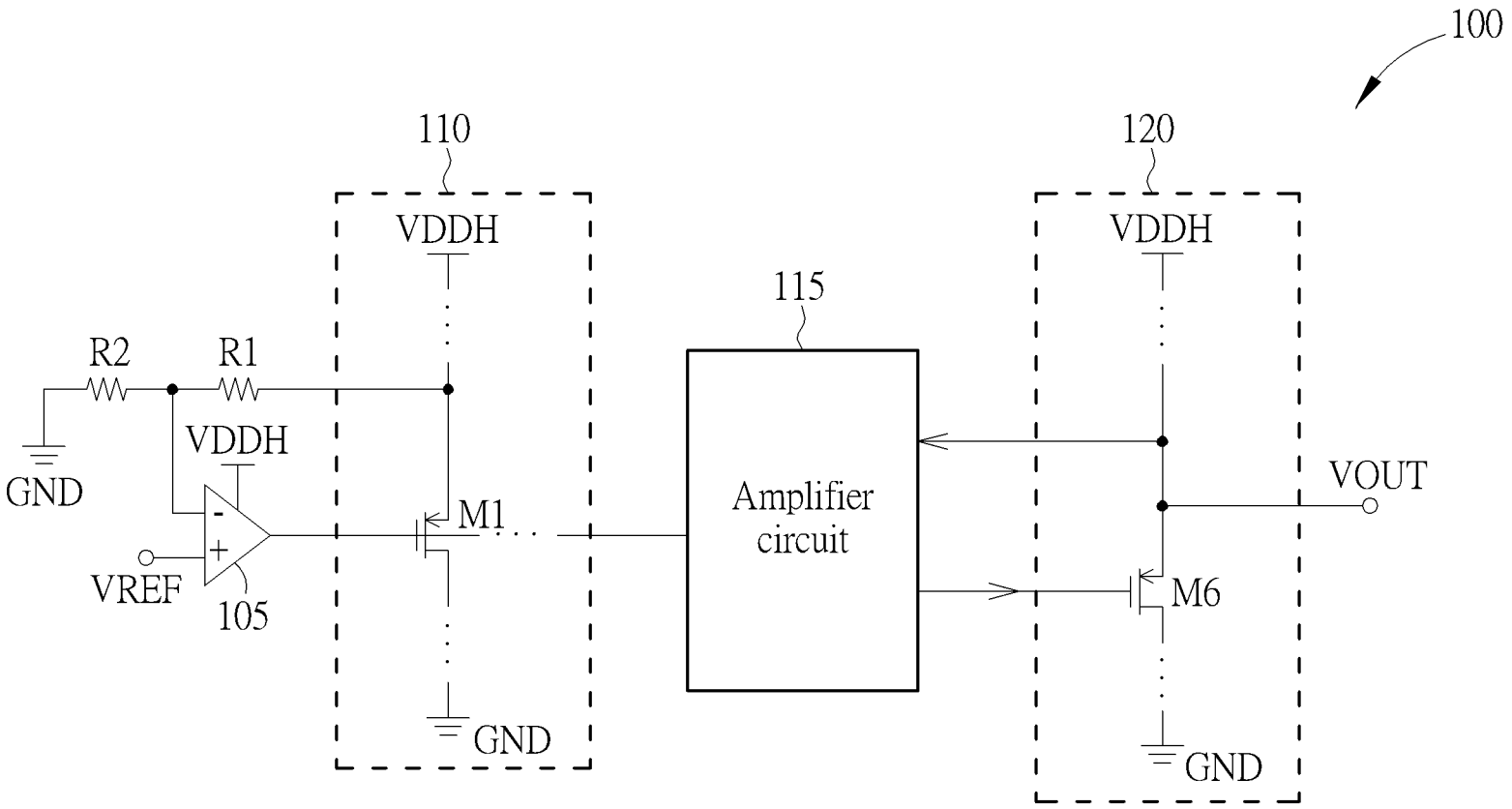
FIG. 1 is simplified diagram of a voltage regulator apparatus according to embodiments of the invention.

FIG. 1 is simplified diagram of a voltage regulator apparatus 100 according to embodiments of the invention. The voltage regulator apparatus 100 comprises an operational amplifier (OP) 105, a first resistor R1, a second resistor R2, a core stage circuit 110, an amplifier circuit 115, and an output circuit 120 (or called an output branch circuit).

The OP 105 has a first input terminal (e.g. the non-negative input node) coupled to a first reference voltage VREF, a second input terminal such as the negative input node, and an output terminal. The OP 105 is supplied/powered with a voltage level VDDH. The first resistor R1 has a first terminal coupled to the second input terminal of the OP 105. The second resistor R2 is coupled between the first resistor R1 and a ground level.

The core stage circuit 110 is coupled between the OP 105 and the amplifier circuit 115. The core stage circuit 105 at least comprises a driving transistor M1 having a control terminal (e.g. a gate) coupled to the output terminal of OP 105 and a first terminal (e.g. a source) coupled to a second terminal of the first resistor R1.

The amplifier circuit 115 is coupled between the output terminal of OP 105 and the output circuit 120. The amplifier circuit 115 is configured to sense an output voltage VOUT of the voltage regulator apparatus 100 to amplify the sensed voltage with a specific gain to regulate a specific transistor M6 of the output circuit 120. The amplifier circuit 115 is arranged to form an extra feedback circuit loop to generate a control signal to control the specific transistor M6 based on the output voltage VOUT so as to provide a loop to boost the gain of the overall system as well as an improved/better PSRR (power supply rejection ratio) performance.

The output circuit 120 is coupled to the amplifier circuit 115, and at least comprises the specific transistor M6 having a control terminal (e.g. a gate) controlled by the amplifier circuit 115. The output voltage VOUT is generated at a first terminal (e.g. a source) of the specific transistor M6.

It should be noted that the amplifier circuit 115 can control the voltage level provided for the gate of the specific transistor M6 within the output circuit 120 to provide/add another loop gain(s) so as to boost the overall loop gain even when a power transistor (not shown on FIG. 1) included within the output circuit 120 enters and operates in the triode region; such power transistor is arranged to be coupled between the specific transistor M6 and the voltage level VDDH. Compared to this, the overall gain of a conventional voltage regulator will be degraded due to that a power transistor enters the triode region.

Figure 2:
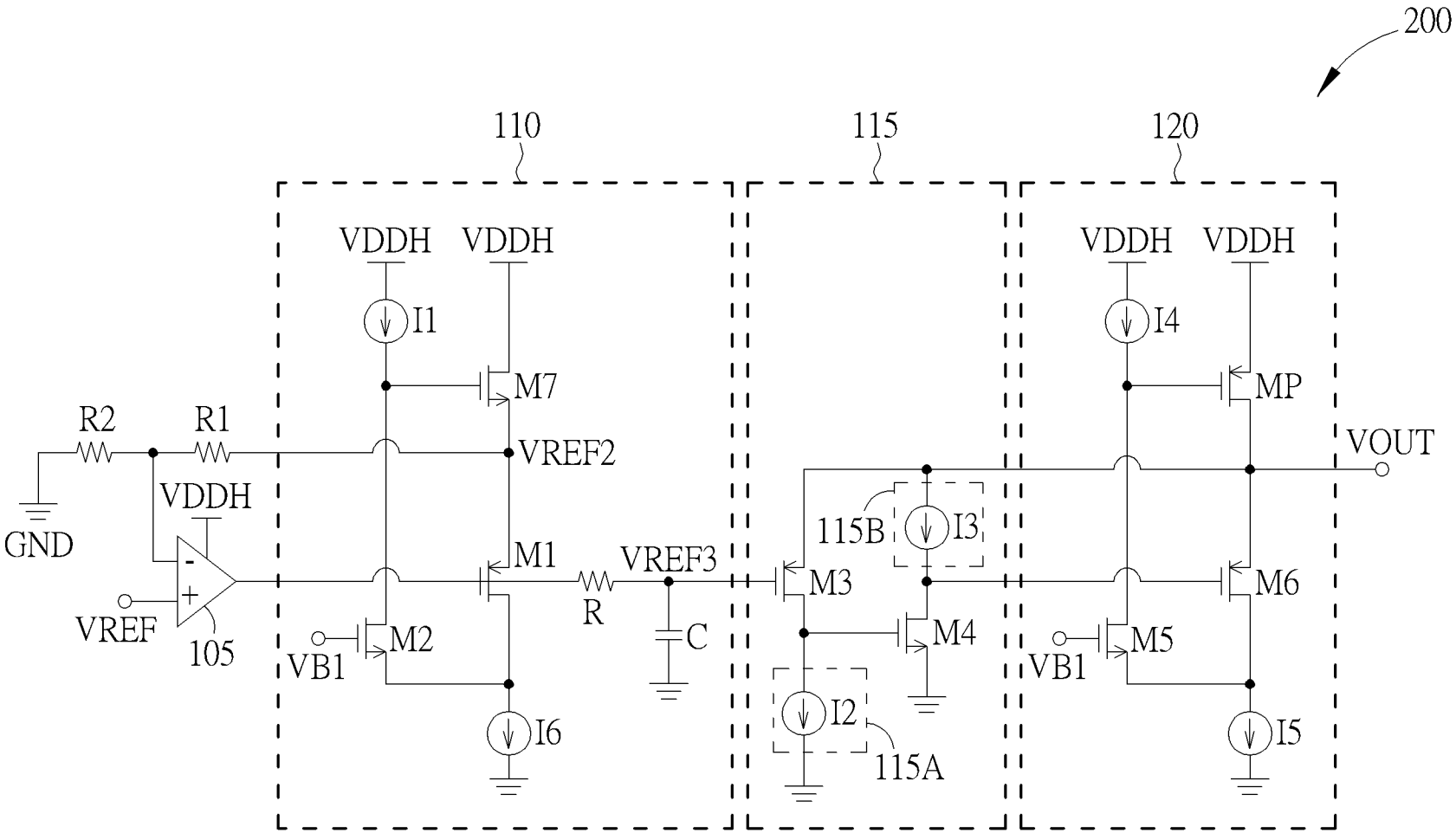
FIG. 2 is a circuit diagram of an implementation circuit based on the design of apparatus in FIG. 1 according to a first embodiment of the invention.

FIG. 2 is a circuit diagram of the implementation circuit 200 based on the design of apparatus 100 in FIG. 1 according to a first embodiment of the invention. The core stage circuit 110 for example comprises a current source I1, a transistor M2, a transistor M7, a current source I6, and the driving transistor M1, resistor R and capacitor C. A bias voltage level VB1 is coupled to the gate of the transistor M2. The gate of transistor M7 is coupled between the current source I1 and the drain of transistor M2, and the source of transistor M7 is coupled to the supply voltage level VDDH. The source of transistor M2 is coupled to an intermediate node between an impedance unit/circuit such as the current source I6 (but not limited) and the drain of transistor M1. The current source I6 is coupled between the ground level and the drain of driving transistor M1. The source of transistor M1 is coupled to one end of the resistor R1 and the drain of transistor M7, and the voltage level VREF2 is generated at the source of transistor M1, i.e. the drain of transistor M7.

Figure 6:
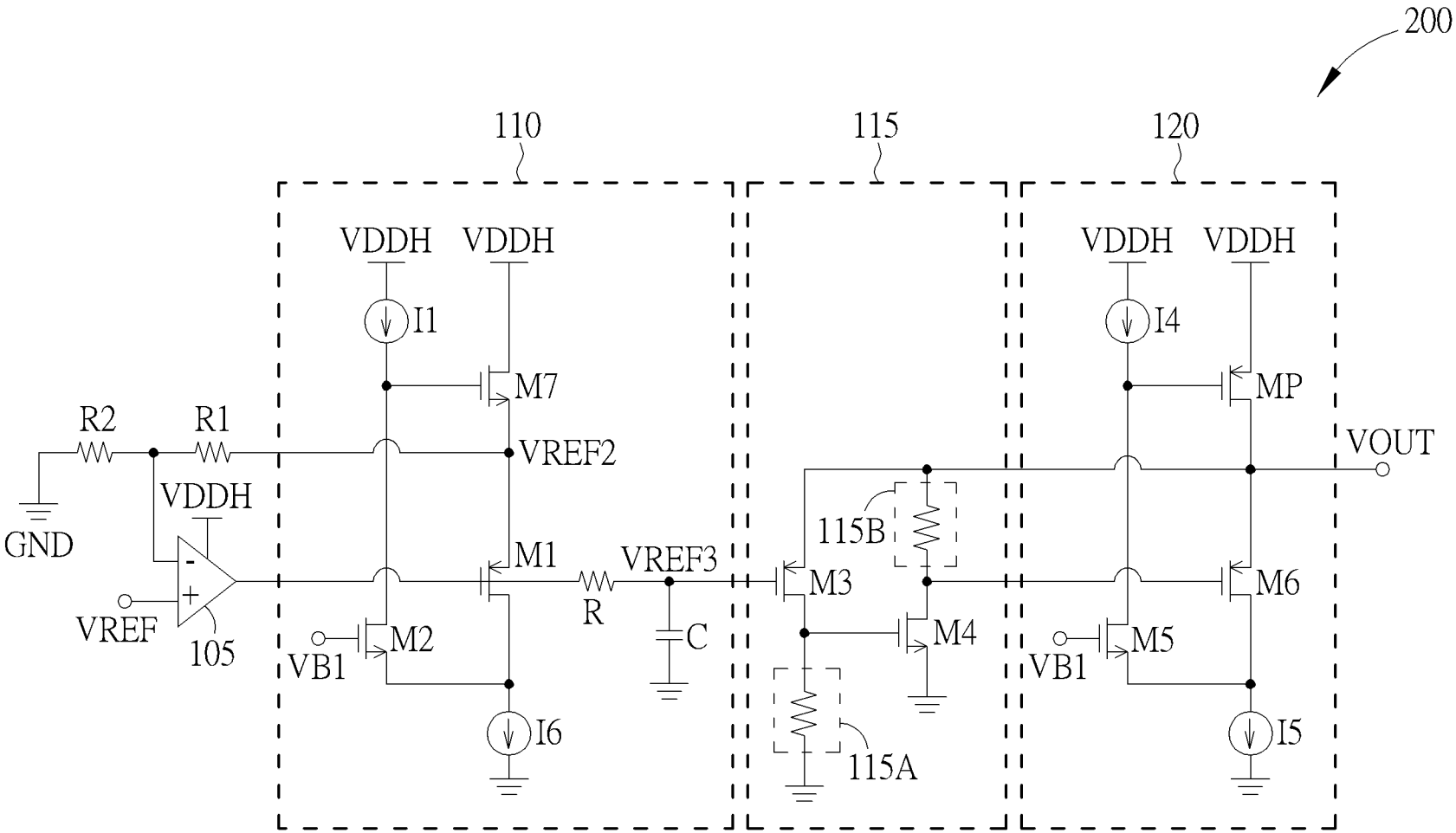
FIG. 6 is a circuit diagram of an implementation circuit comprising impedance units implemented by resistors based on the design of apparatus in FIG. 2.
Figure 7:
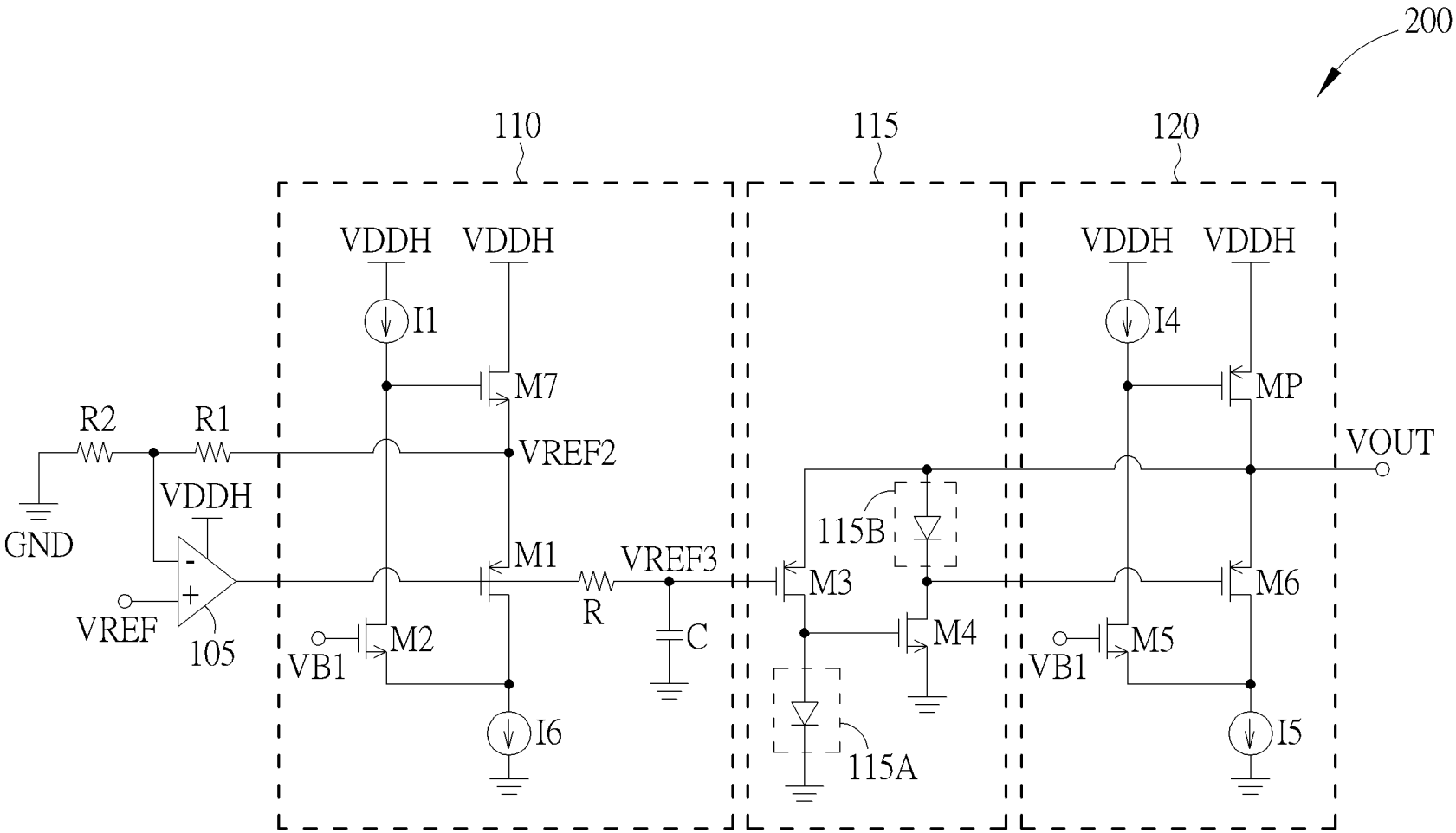
FIG. 7 is a circuit diagram of an implementation circuit comprising impedance units implemented by diodes based on the design of apparatus in FIG. 2.

The amplifier circuit 115 comprises the transistor M3, the impedance unit 115A, the transistor M4, and the impedance unit 115B. The impedance units 115A and 115B respectively for example are implemented by using current sources I2 and I3. In other embodiments, the impedance units 115A and 115B may be respectively implemented by one of a resistor, a current source, and a diode. FIG. 6 is a circuit diagram of an implementation circuit comprising impedance units implemented by resistors based on the design of apparatus in FIG. 2. FIG. 7 is a circuit diagram of an implementation circuit comprising impedance units implemented by diodes based on the design of apparatus in FIG. 2. These modifications also fall within the scope of the invention. The transistor M3 and the current source I2 are formed as a common gate amplifier circuit, and the transistor M4 and the current source I3 are formed as a common source amplifier circuit.

The output circuit 120 comprises a current source I4, a transistor M5, the specific transistor M6, a power transistor (i.e. a driving current transistor) MP which is implemented by using a PMOS transistor (but not limited), and an impedance unit/circuit such as the current source I5 (but not limited). The output voltage VOUT of apparatus 200 is generated at the source of transistor M6, i.e. the drain of power MOS transistor MP. The current source I5 is coupled between the drain of transistor M6 and the ground level.

The gate of transistor M3 is connected to the voltage VREF3 which is used as a common voltage for the transistor M3. The output voltage VOUT is used as an input for the transistor M3, and the transistor M3 amplifies and outputs an output signal at its drain terminal.

The gate of transistor M4 is coupled to the drain of the transistor M3, and the source of transistor M4 is coupled to the ground level. The transistor M4 is used as a transconductance amplifier to provide an output signal at its drain terminal to control the gate of transistor M6 (i.e. the specific transistor of output circuit 120).

Through device matching and operation point matching of the transistors M1 and M3, the output voltage VOUT can be adjusted to be equivalently equal to or approximate to the voltage level VREF2 as shown by the following equation:

$$VOUT \cong VREF2 = \frac{R1 + R2}{R2} \times VREF$$

Since the amplifier circuit 115 is inserted between the core stage circuit 110 and output circuit 120 and forms another circuit loop which is arranged to perform feedback control to use the output voltage VOUT to control the gate of transistor M6, this significantly improves/boosts the loop gain of the overall apparatus 100 as well as keeps/maintains the better PSRR performance. It is noted that the noise caused by the OP 105 and resistor R1/R2 are not contributed to or propagated to the output voltage VOUT of the apparatus 100/200.

It should be noted that in real implementation the impedance unit implemented by the current source I6 and the impedance unit implemented by the current source I2 are matched devices so as to control the bias voltage more accurately. However, this is not intended to be a limitation. In other embodiment, the current source I6 may be replaced by a resistor. In addition, the current source I5 may be replaced by another different resistor. This modification also falls within the scope of the invention.

Alternatively, in one embodiment, the resistor R and capacitor C may be optional. The core stage circuit 110 may exclude the resistor R and capacitor C in other embodiments. That is, the output terminal of the OP 105 may be directly coupled to the gate of transistor M3. This modification also falls within the scope of the invention.

Figure 3:
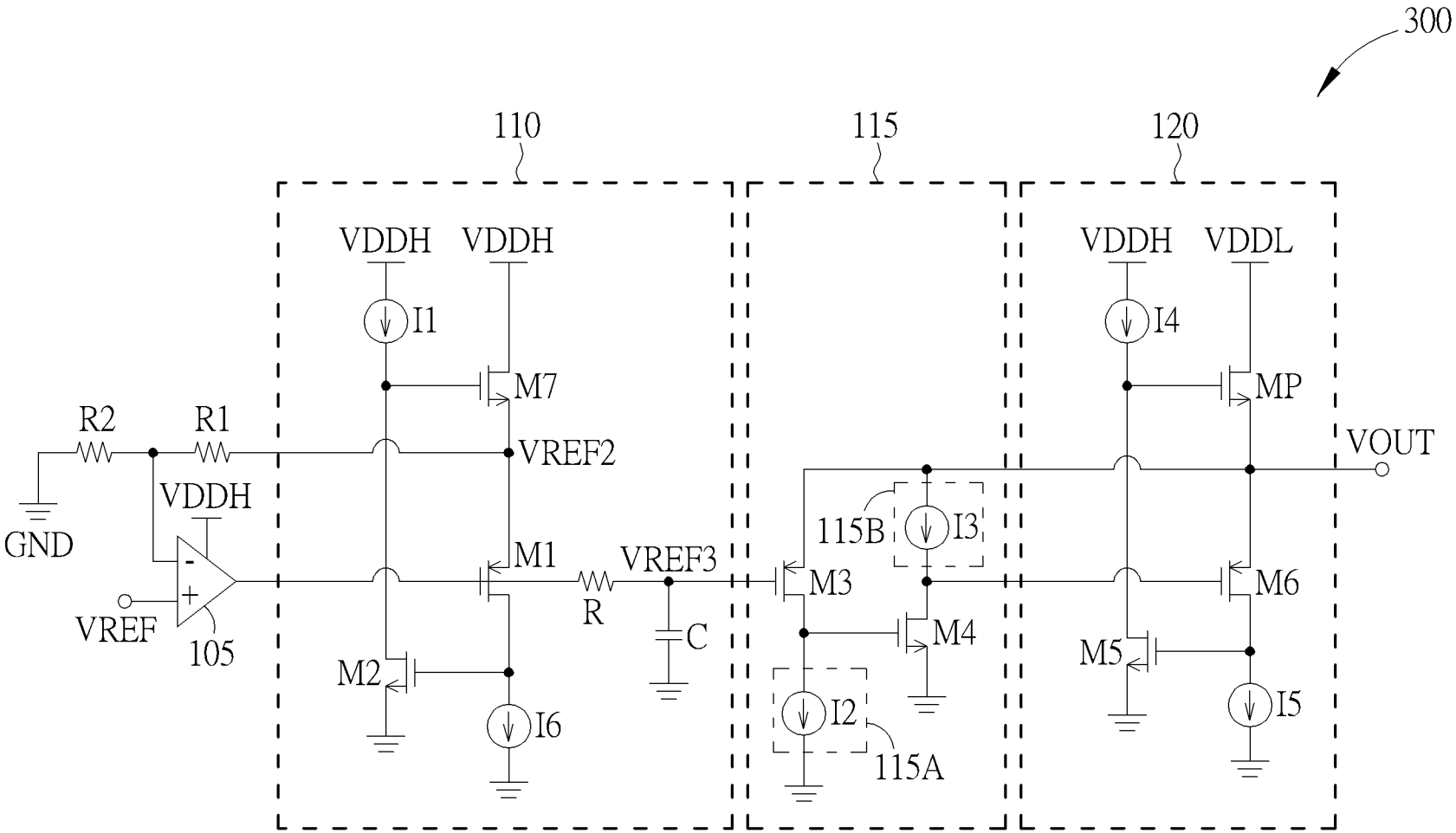
FIG. 3 is a circuit diagram of an implementation circuit based on the voltage regulator apparatus of FIG. 1 according to a second embodiment of the invention.

Alternatively, in other embodiments, the power transistor MP may be implemented by using a NMOS transistor. FIG. 3 is a circuit diagram of the implementation circuit 300 based on the voltage regulator apparatus 100 of FIG. 1 according to a second embodiment of the invention. In this embodiment, the core stage circuit 110 for example comprises the current source I1, transistor M2, NMOS transistor M7, current source I6, and the driving transistor M1, resistor R and capacitor C. The gate of transistor M2 is coupled to the drain of driving transistor M1, and the current source I6 is coupled between the gate of transistor M2 and the ground level to provide a current I6. The source of transistor M2 is coupled to the ground level, and the drain of transistor M2 is coupled to the gate of the transistor M7. Additionally, the output circuit 120 comprises the current source I4, transistor M5, current source I5, the specific transistor M6, and power transistor (i.e. adriving current transistor) MP which is implemented by using a NMOS transistor (but not limited). The output voltage VOUT of apparatus 300 is generated at the source of transistor M6, i.e. the source of power MOS transistor MP. Further, the drain of power NMOS transistor MP in FIG. 3 is coupled to a slightly lower supply voltage level VDDL.

Figure 4:
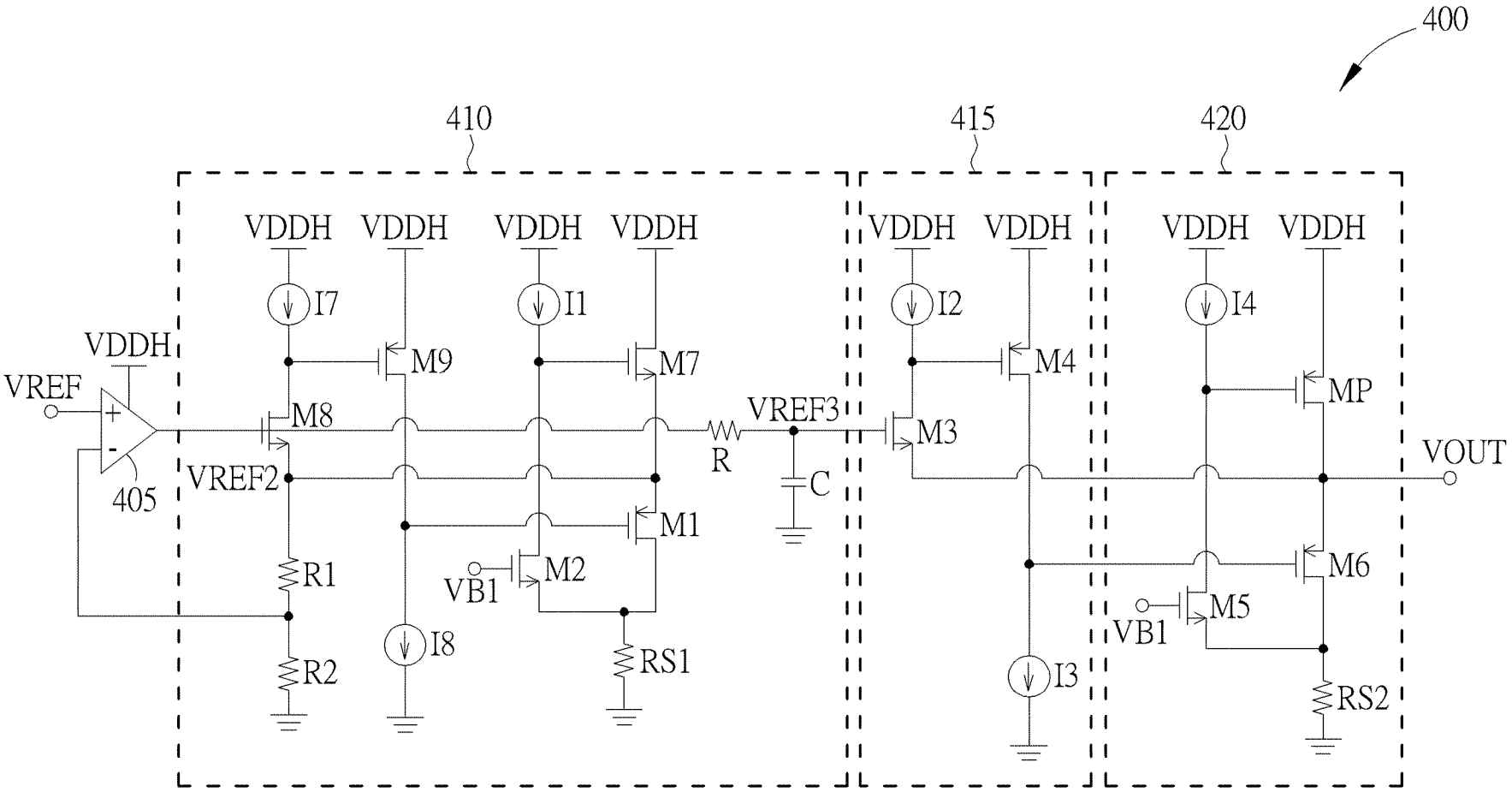
FIG. 4 is a circuit diagram of an implementation circuit based on the voltage regulator apparatus of FIG. 1 according to a third embodiment of the invention.

In other embodiments, in response to the different design of the core stage circuit, the amplifier circuit may also have a slightly different circuit design. FIG. 4 is a circuit diagram of the apparatus 400 according to a third embodiment of the invention. The voltage regulator apparatus 400 comprises an operational amplifier (OP) 405, the first resistor R1, the second resistor R2, a core stage circuit 410, an amplifier circuit 415, and an output circuit 420 (or called an output branch circuit).

The OP 405 has a first input terminal (e.g. the non-negative input node) coupled to the first reference voltage VREF, a second input terminal such as the negative input node, and an output terminal. The first resistor R1 has a first terminal coupled to the second input terminal of the OP 405. The second terminal of first resistor R1 is coupled to an end of a driving transistor included within the core stage circuit 410. The second resistor R2 is coupled between the first resistor R1 and the ground level.

The core stage circuit 410 is coupled between the OP 405 and the amplifier circuit 415. The core stage circuit 405 at least comprises the driving transistor M8 mentioned above wherein such driving transistor M8 has a control terminal (e.g. a gate) coupled to the output terminal of OP 405, a first terminal (e.g. the source) coupled to a second terminal of the first resistor R1, and a second terminal (e.g. the drain) coupled to a current source I7 within the core stage circuit 410.

In addition, in this example, the core stage circuit 410 further comprises a transistor M9, current source I8, transistor M2, current source I1, transistor M1, transistor M7, an impedance unit such as resistor RS1, resistor R, and the capacitor C. The current source I7 is coupled between the voltage level VDDH and the drain of driving transistor M8 to provide a current I7 passing through the driving transistor M8. The transistor M9 has a gate coupled to the drain of driving transistor M8, a source coupled to the supply voltage level VDDH, and a drain coupled to the current source I8 which is arranged to provide a current I8. The transistor M2 has a gate coupled to a bias voltage VB1, a source coupled to one end of the resistor RS1, and a drain coupled to the current source I1 which is arranged to provide a current I1 passing through the transistor M2. The transistor M7 has a gate coupled to the drain of transistor M2, a drain coupled to the supply voltage level VDDH, and a source coupled to the source of transistor M1. The transistor M1 has a gate coupled to the drain of transistor M9, the source coupled to the source of transistor M7, and a drain coupled to one end of the resistor RS1. The resistor RS1 is coupled between the transistor M1 and the ground level.

In addition, the resistor R is coupled between the output terminal of OP 405 and a first end of the capacitor C which is coupled between one end of the resistor R and the ground level. The voltage VREF3 is generated at the output node of core stage circuit 410, i.e. the first end of capacitor C. It should be noted that the resistor R and capacitor C may be optional in other embodiments. That is, in other embodiments, the output terminal of OP 405 may be directly coupled to the gate of the transistor M3 included within the amplifier circuit 415.

The amplifier circuit 415 is coupled between the output terminal of OP 405 and the output circuit 420. The amplifier circuit 415 is configured to sense the output voltage VOUT of the voltage regulator apparatus 400 to amplify the sensed voltage with a specific gain to regulate the specific transistor M6 of the output circuit 420. The amplifier circuit 415 is arranged to form at least one feedback circuit loop to control the specific transistor M6 so as to provide a loop gain to boost the gain of the overall system as well as an improved/better PSRR (power supply rejection ratio) performance.

The operation and functions of output circuit 420 are similar to those of output circuit 120, and are not detailed for brevity. The output circuit 420 comprises the impedance unit such as resistor RS2.

The amplifier circuit 415 comprises the transistor M3, the current source I2, the transistor M4, and the current source I3. In other embodiments, each of the current sources I2 and I3 may be implemented by a resistor, a diode, or another different impedance unit/component. This modification also falls within the scope of the invention. The transistor M3 and the current source I2 are formed as a common gate amplifier circuit, and the transistor M4 and the current source I3 are formed as a common source amplifier circuit.

The power transistor (i.e. a driving current transistor) MP which is implemented by a PMOS transistor. The output voltage VOUT of voltage regulator apparatus 400 is generated at the source of transistor M6, i.e. the drain of power MOS transistor MP.

The gate of transistor M3 is connected to the voltage VREF3 which is used as a common voltage for the transistor M3. The output voltage VOUT is used as an input for the transistor M3, and the transistor M3 amplifies and outputs an output signal at its drain terminal. The gate of transistor M4 is coupled to the drain of the transistor M3, and the source of transistor M4 is coupled to the voltage level VDDH. The transistor M4 is used as a transcondutance amplifier to provide an output signal at its drain terminal to control the gate of transistor M6 (i.e. the specific transistor of output circuit 420).

Through device matching and operation point matching of the transistors M8 and M3, the output voltage VOUT can be adjusted to be equivalently equal to or approximate to the voltage level VREF2 as shown by the following equation:

$$VOUT \cong VREF2 = \frac{R1 + R2}{R2} \times VREF$$

Since the amplifier circuit 415 forms another circuit loop, it is able to perform feedback control to use the output voltage VOUT to control the gate of specific transistor M6 so as to significantly improve/boost the loop gain of the overall apparatus 400 as well as keep/maintain the better PSRR performance.

Figure 5:
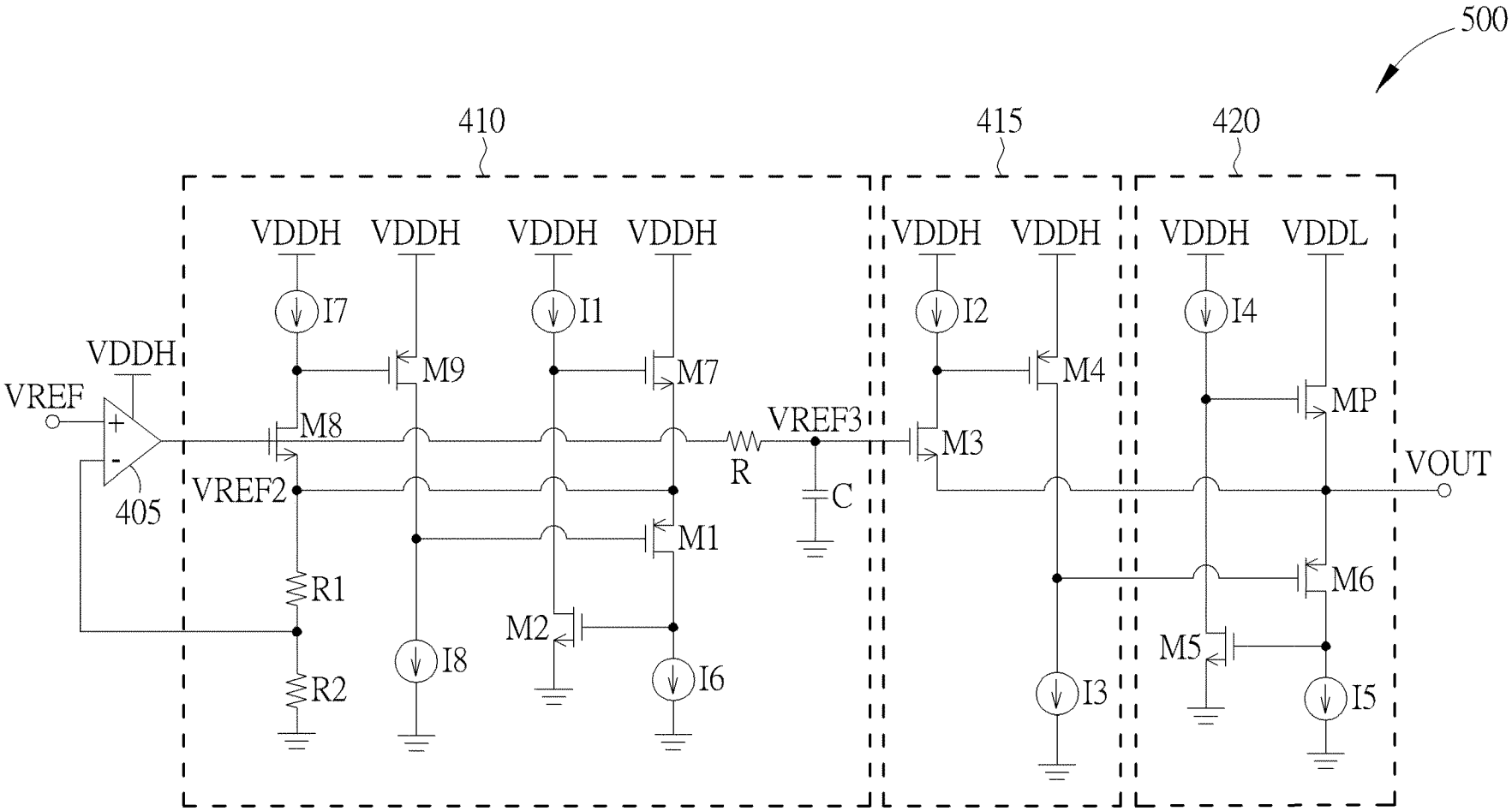
FIG. 5 is a circuit diagram of an implementation circuit based on the voltage regulator apparatus of FIG. 1 according to a fourth embodiment of the invention.

Alternatively, in other embodiments, the power transistor MP may be implemented by using a NMOS transistor. FIG. 5 is a circuit diagram of the implementation circuit 500 based on the voltage regulator apparatus 100 of FIG. 1 according to a fourth embodiment of the invention. In this embodiment, the core stage circuit 410 for example comprises the current source I7, transistor M1, transistor M9, current source I8, current source I1, transistor M2, transistor M1, an impedance unit such as current source I6, and the driving transistor M8, resistor R and capacitor C. The gate of transistor M2 is coupled to the drain of transistor M1, and the current source I6 is coupled between the gate of transistor M2 and the ground level to provide a current I6. The source of transistor M2 is coupled to the ground level, and the drain of transistor M2 is coupled to the gate of the transistor M7. Additionally, the output circuit 420 comprises the current source I4, transistor M5, an impedance unit such as current source I5, the specific transistor M6, and power transistor (i.e. adriving current transistor) MP which is implemented by using a NMOS transistor (but not limited). The output voltage VOUT of apparatus 500 is generated at the source of transistor M6, i.e. the source of power MOS transistor MP. Further, the drain of power NMOS transistor MP in FIG. 5 is coupled to a slightly lower supply voltage level VDDL.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A voltage regulator apparatus, comprising:

an operational amplifier, having a first input terminal coupled to a reference voltage, a second input terminal, and an output terminal;

a first resistor, having a first terminal coupled to the second input terminal;

a second resistor, coupled between the first resistor and a ground level;

a driving transistor having a control terminal coupled to the output terminal of the operational amplifier and a first terminal coupled to a second terminal of the first resistor;

an amplifier circuit, coupled between the output terminal of the operational amplifier and an output circuit, configured to sense an output voltage of the voltage regulator apparatus to amplify the sensed voltage with a gain to regulate a first transistor of the output circuit to generate the output voltage at a first terminal of the first transistor; and the output circuit, having the first transistor having a control terminal controlled by the amplifier circuit, wherein the output voltage generated at the first terminal of the first transistor is distinct from a voltage level generated at the first terminal of the driving transistor.

2. The voltage regulator apparatus of claim 1, wherein the amplifier circuit comprises:

a second transistor, having a control terminal coupled to the output terminal of the operational amplifier, a first terminal coupled to the output voltage, and a second terminal coupled to a first impedance unit;

the first impedance unit, coupled between the second transistor and a reference voltage level;

wherein the first transistor of the output circuit is controlled according to a signal at an intermediate node between the second transistor and the first impedance unit.

3. The voltage regulator apparatus of claim 2, wherein the reference voltage level is a ground level.

4. The voltage regulator apparatus of claim 2, wherein the reference voltage level is a supply voltage level.

5. The voltage regulator apparatus of claim 2, wherein the first terminal of the second transistor is a source terminal and the second terminal of the second transistor is a drain terminal, and the second transistor and the first impedance unit are used as a common gate amplifier.

6. The voltage regulator apparatus of claim 5, wherein the first impedance unit is one of a current source circuit, a resistor circuit, and a diode.

7. The voltage regulator apparatus of claim 2, wherein the amplifier circuit further comprises:

a third transistor, having a control terminal coupled to the intermediate node between the second transistor and the first impedance unit, a first terminal coupled to a reference voltage level, and a second terminal coupled to a second impedance unit;

the second impedance unit, coupled to the third transistor and coupled to one of the output voltage, a ground level, and a supply voltage level;

wherein the first transistor of the output circuit is controlled according to a signal generated at an intermediate node between the third transistor and the second impedance unit.

8. The voltage regulator apparatus of claim 7, wherein the second impedance unit is coupled between the third transistor and the output voltage.

9. The voltage regulator apparatus of claim 7, wherein the second impedance unit is coupled between the third transistor and the ground level.

10. The voltage regulator apparatus of claim 7, wherein the second impedance unit is coupled between the third transistor and the supply voltage level.

11. The voltage regulator apparatus of claim 7, wherein the reference voltage level is the ground level.

12. The voltage regulator apparatus of claim 7, wherein the reference voltage level is the supply voltage level.

13. The voltage regulator apparatus of claim 7, wherein the first terminal of the third transistor is a source terminal and the second terminal of the third transistor is a drain terminal, and the third transistor and the second impedance unit are used as a common source amplifier.

14. The voltage regulator apparatus of claim 13, wherein the second impedance unit is one of a current source circuit, a resistor circuit, and a diode.

15. A voltage regulator apparatus, comprising:

an operational amplifier, having a first input terminal coupled to a reference voltage, a second input terminal, and an output terminal;

a first resistor, having a first terminal coupled to the second input terminal;

a second resistor, coupled between the first resistor and a ground level;

a driving transistor having a control terminal coupled to the output terminal of the operational amplifier and a first terminal coupled to a second terminal of the first resistor;

an amplifier circuit, coupled to the output terminal of the operational amplifier, configured to sense an output voltage of the voltage regulator apparatus to amplify the sensed voltage with a gain to regulate a first transistor of an output circuit; and the output circuit, having the first transistor having a control terminal controlled by the amplifier circuit, wherein the output voltage is generated at a first terminal of the first transistor;

wherein the amplifier circuit comprises:

a second transistor, having a control terminal coupled to the output terminal of the operational amplifier, a first terminal coupled to the output voltage, and a second terminal coupled to a first impedance unit;

the first impedance unit, coupled between the second transistor and a reference voltage level;

wherein the first transistor of the output circuit is controlled according to a signal at an intermediate node between the second transistor and the first impedance unit.

* * * * *